US008407969B2

(12) United States Patent
Myszak

(10) Patent No.: US 8,407,969 B2
(45) Date of Patent: Apr. 2, 2013

(54) PHARMACEUTICAL DUST EXTRACTION SYSTEM AND METHOD

(75) Inventor: Nicholas R. Myszak, Memphis, TN (US)

(73) Assignee: McKesson Corporation, San Francisco, CA (US)

( * ) Notice: Subject to any disclaimer, the term of this patent is extended or adjusted under 35 U.S.C. 154(b) by 266 days.

(21) Appl. No.: 13/047,861

(22) Filed: Mar. 15, 2011

(65) Prior Publication Data

US 2012/0233969 A1 Sep. 20, 2012

(51) Int. Cl.
*B65B 1/04* (2006.01)

(52) U.S. Cl. ..... 53/473; 53/235; 53/111 R

(58) Field of Classification Search ..... 53/473, 53/235, 111 R; 15/405, 300.1, 345
See application file for complete search history.

(56) References Cited

U.S. PATENT DOCUMENTS 4,150,751 A * 4/1979 Romagnoli ..... 209/682
4,680,464 A * 7/1987 Bross ..... 250/223 R
5,369,940 A * 12/1994 Soloman ..... 53/501

* cited by examiner

*Primary Examiner* — Hemant M Desai
(74) *Attorney, Agent, or Firm* — Alston & Bird LLP

(57) ABSTRACT

A dust extraction system and method are provided to collect some of the dust generated during handling of tablets during a tablet packaging process. For example, a tablet packaging system may be provided that includes a vibrating tray configured to feed a plurality of tablets to respective packages. The tablet packaging system may also include a first gas nozzle configured to direct a first flow of gas across the vibrating tray with the first flow of gas having a spaced relationship from the vibrating tray. The tablet packaging system may also include a second gas nozzle configured to direct a second flow of gas toward the vibrating tray. Further, the tablet packaging system may include a receiving hood configured to collect at least a portion of the gas provided by the first and second gas nozzles and to collect dust from the plurality of tablets.

20 Claims, 2 Drawing Sheets

PHARMACEUTICAL DUST EXTRACTION SYSTEM AND METHOD

TECHNOLOGICAL FIELD

Embodiments of the present invention relate generally to tablet packaging systems and methods and, more particularly, to a dust extraction system and method for use in conjunction with a tablet packaging process.

BACKGROUND

During the handling of pharmaceutical tablets, particularly uncoated tablets, dust may be created. In this regard, tablets are generally pressed into their tablet form such that subsequent handling of the tablets may cause erosion of the tablets and create dust. While the amount of dust may be reduced by coating the tablets, coatings add to the expense of the resulting tablet and may also increase the manufacturing time required to produce the tablets. Thus, uncoated tablets are desirable in many instances even though the handling of the uncoated tablets may create dust.

By way of example, tablets may be manufactured and then packaged in bulk for shipment to a repackaging facility at which the tablets are repackaged into bottles, blister packs or other containers. During shipment, the tablets may erode so as to create dust. During repackaging, the tablets may be further handled resulting in the creation of additional dust and the dispersion of the dust into the surrounding environment. For example, tablets may be repackaged into bottles, blister packs or other containers by placing the tablets on a vibrating tray. A vibrating tray includes a plurality of channels. The vibration of the tray generally separates the tablets into respective channels which, in turn, feed the tablets toward the respective bottle, blister package or other container. While effective in separating and directing the tablets to the bottles, blister packages or other containers, the handling of the tablets to place the tablets on the vibrating tray and the subsequent movement of the tablets across the vibrating tray may create additional dust.

Some of the dust may be packaged along with the tablets in a bottle, blister package or the like. In some instances, dust that is packaged within a bottle, blister package or other container may lead to customer complaints or inquiries, particularly in instances in which a meaningful quantity of dust is disposed within a respective bottle, blister package or the like. The dust may also become airborne and may collect on various surfaces, including on various instruments. For example, a tablet packaging system may include a counter for counting the number of tablets that are placed in a bottle or other container. In instances in which the dust collects on the counter, such as the sensor of the counter, the resulting count of the number of tablets within a bottle or other container may be incorrect. A tablet packaging system may also include other types of sensors, such as sensors utilized for the verification of labels that are placed on the bottles, blister packages or the like. Dust may also collect on these sensors which may similarly result in discrepancies in the operation of the sensors, such as inaccuracies in the verification of labels on bottles or other containers. Still further, the dust in the air may be an annoyance for workers in the room.

The dust that is generated during the repackaging of tablets may also cause the room in which the tablet repackaging is conducted to be taken out of service and cleaned more frequently than if the handling of the tablets did not produce as much dust. In this regard, tablets may be packaged in a clean room environment. Although the clean room environment has a number of air exchanges each hour, the air handling system includes a number of filters so that a significant amount of the dust generated by handling of the tablets remains within the room. As a result of having to halt repackaging of the tablets in order to clean the room more frequently than otherwise required, the repackaging of the tablets may be delayed, thereby reducing the efficiency of and potentially increasing the costs associated with the repackaging process.

BRIEF SUMMARY

A dust extraction system and method are therefore provided in accordance with one embodiment of the present invention in order to collect some of the dust generated during handling of tablets during a tablet packaging process. By collecting at least some of the dust, less dust may escape into the surrounding environment and, as a result, the packaging process may not need to be interrupted as frequently for cleaning, thereby increasing the efficiency of the packaging process. By collecting at least some of the dust, the dust extraction system and method of one embodiment may also reduce the amount of dust that collects in bottles, blister packages or other containers and may accordingly reduce the number of customer inquiries regarding the dust. Further, the collection of at least some of the dust by the dust extraction system and method of one embodiment may reduce the amount of dust that collects on sensors, such as sensors for counters, label verification systems or the like, in order to permit the sensors to continue to perform in an accurate manner for longer periods of time.

In one embodiment, a tablet packaging system is provided that includes a vibrating tray configured to feed a plurality of tablets to respective packages. The tablet packaging system of this embodiment also includes a first gas nozzle configured to direct a first flow of gas across the vibrating tray with the first flow of gas having a spaced relationship from the vibrating tray. The tablet packaging system may also include a second gas nozzle configured to direct a second flow of gas toward the vibrating tray. Further, the tablet packaging system may include a receiving hood configured to collect at least a portion of the gas provided by the first and second gas nozzles and to collect dust from the plurality of tablets. The receiving hood may include, for example, a filter and an exhaust fan downstream of the filter. As such, the dust extraction system need not include a vacuum system for collecting the dust.

The tablet packaging system of one embodiment includes a plurality of first gas nozzles and a plurality of second gas nozzles. The plurality of first and second gas nozzles of this embodiment may be spaced across the vibrating tray. In addition, the plurality of first and second gas nozzles may be arranged in pairs with each pair including a respective first gas nozzle and respective second gas nozzle.

The first gas nozzle may be configured to direct the first flow of gas in a first direction and the second gas nozzle may be configured to direct the second flow of gas in a second direction that is angularly offset from the first direction by an acute angle. In one embodiment, the first and second gas nozzles are configured such that the first flow of gas is greater than the second flow of gas. For example, the first and second gas nozzles may be configured such that the first flow of gas is at least three times greater than the second flow of gas.

In another embodiment, a dust extraction system is provided that includes a first gas nozzle configured to direct the first flow of gas in a first direction across a vibrating tray that is configured to carry a plurality of tablets. The first gas nozzle of this embodiment is configured to direct the first flow of gas to have a spaced relationship from the vibrating tray. The dust extraction system of this embodiment also includes a second gas nozzle configured to direct a second flow of gas in a second direction toward the vibrating tray. The second direction may be angularly offset from the first direction by an acute angle. The dust extraction system may also include a receiving hood configured to collect at least a portion of the gas provided by the first and second gas nozzles and to collect dust from a plurality of tablets. The receiving hood may include, for example, a filter and an exhaust fan downstream.

In one embodiment, the dust extraction system includes a plurality of first gas nozzles and a plurality of second gas nozzles. The plurality of first and second gas nozzles may be spaced across a vibrating tray. The plurality of first and second gas nozzles may be arranged in pairs with each pair including a respective first gas nozzle and a respective second gas nozzle. In one embodiment, the first and second gas nozzles may be configured such that the first flow of gas is greater than the second flow of gas. For example, the first and second gas nozzles may be configured such that the first flow of gas is at least three times greater than the second flow of gas.

In a further embodiment, a method for packaging tablets is provided and includes causing movement of a vibrating tray so as to feed a plurality of tablets to respective packages. The method also includes directing a first flow of gas across a vibrating tray, the first flow of gas having a spaced relationship from the vibrating tray. The method also includes directing a second flow of gas toward the vibrating tray and collecting at least a portion of the first and second flows of gas and collecting dust from the plurality of tablets. In one embodiment, the collection of least a portion of the first and second flows of gas and the collection of dust from the plurality of tablets may include trapping the dust in a filter.

In directing the first flow of gas across the vibrating tray, the method of one embodiment may also create a region of low pressure to draw the dust into the first flow of gas. Additionally or alternatively, in directing the first flow of gas across the vibrating tray the method of one embodiment may direct the plurality of first flows of gas across the vibrating tray. Similarly, in directing the second flow of gas toward the vibrating tray, the method of one embodiment may direct the plurality of second flows of gas toward the vibrating tray. The first and second flows of gas may be spaced across the vibrating tray.

Directing the first flow of gas may include directing the first flow of gas in the first direction. Additionally, directing the second flow of gas may include directing the second flow of gas in the second direction that is angularly offset from the first direction by an acute angle. In one embodiment, the first flow of gas is greater than the second flow of gas. For example, the first flow of gas may be at least three times greater than the second flow of gas.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
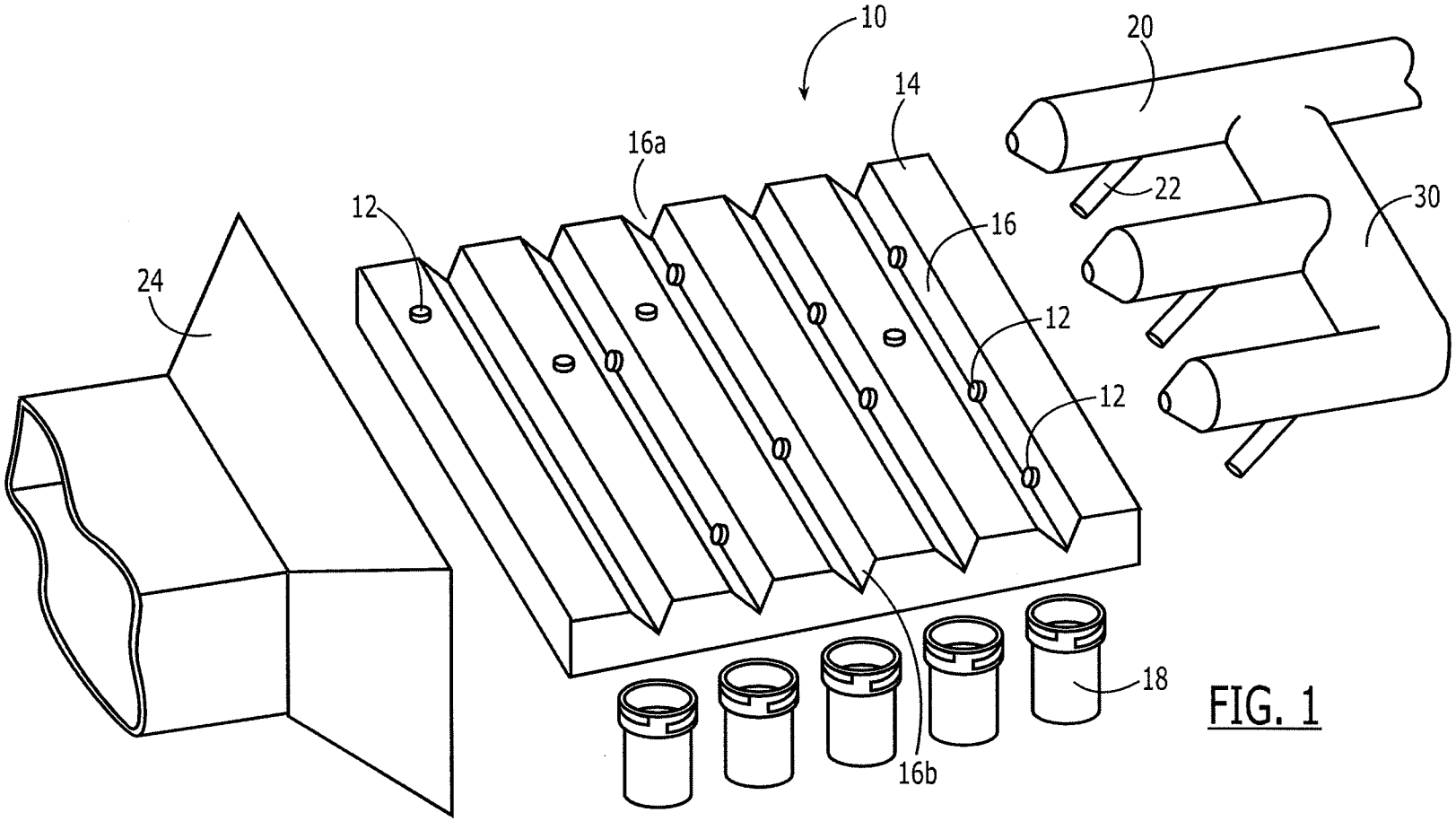
FIG. 1 is a perspective view of a tablet packaging system including a dust extraction system in accordance with one embodiment of the present invention.

Referring now to FIG. 1, a tablet packaging system 10 in accordance with one embodiment of the present invention is illustrated. A tablet packaging system may be configured to package tablets 12 in a variety of different packages, such as bottles, blister packages or other containers. Additionally, the tablet packaging system may be employed in order to repackage tablets that have been manufactured, packaged in bulk, and then transported to the tablet packaging system for repackaging. However, the tablet packaging system may be employed in other settings which do not relate to the repackaging of the tablets.

A tablet packaging system 10 may package any of a wide variety of pharmaceutical tablets 12. While the tablets may be coated, the tablet packaging system may facilitate the packaging of uncoated tablets since the handling of uncoated tablets during packaging generally generates more dust than comparable handling of coated tablets.

As shown in FIG. 1, a tablet packaging system 10 includes a vibrating tray 14 configured to feed a plurality of tablets 12 to respective packages. The vibrating tray of the illustrated embodiment defines a plurality of channels 16 that extend across the vibrating tray. The vibrating tray may also be positioned at an angle such that a first end 16*a* of each channel is elevated relative to an opposed second end 16*b* of the channel. In operation, tablets may be placed upon the vibrating tray and the tray may be caused to vibrate, such as in a reciprocal manner. The vibratory motion of the tray may cause the tablets to gravitate to a respective channel and to then propagate along the respective channel toward the lower second end of the channel. Packages 18, such as bottles, blister packages or other containers may be positioned proximate the second ends of the channels such that the tablets that reach the second ends of the channels are captured by a respective package.

The tablets 12 may carry or otherwise be associated with dust when the tablets are initially placed upon the vibrating tray 14. For example, tablets that have been bulk packaged and then transported may carry dust that was generated during the packaging and transportation processes. Additionally, the movement of the tablets relative to the vibrating tray may also create additional dust by somewhat eroding the tablets. Accordingly, the tablet packaging system 10 of one embodiment of the present invention includes a dust extraction system for collecting at least some of the dust from the plurality of tablets.

Figure 2:
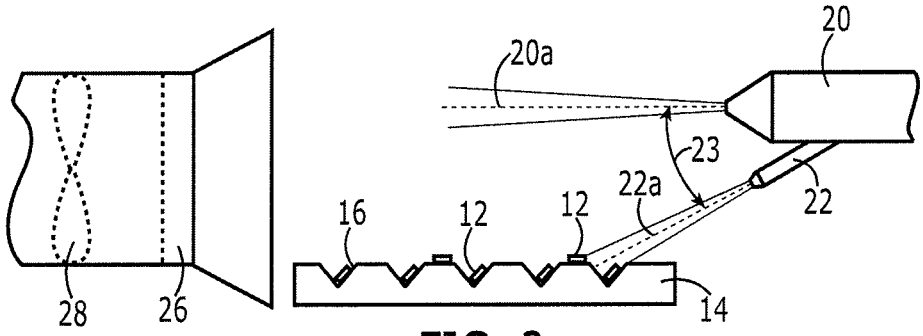
FIG. 2 is a side view of the tablet packaging system including the dust extraction system of FIG. 1.

The dust extraction system may include a first gas nozzle 20 configured to direct a first flow of gas across the vibrating tray 14. The dust extraction system may utilize a variety of different gases, but, in one embodiment, employs air as the gaseous fluid. As shown in FIG. 2, the first gas nozzle is configured to direct the first flow of gas across a vibrating tray in such a manner that the first flow of gas has a spaced relationship from the vibrating tray, that is, the first flow of gas flows over and across the vibrating tray, but is not directed toward the vibrating tray. The first flow of gas or at least a majority of the first flow of gas, does not contact the vibrating tray or the tablets 12 carried by the vibrating tray. As also shown in FIG. 2, the first gas nozzle is configured to direct the first flow of gas in a first direction 20*a* across the vibrating tray. Although the first flow of gas may diverge somewhat upon its exit from the first gas nozzle, the first direction in which the first flow of gas is directed by the first gas nozzle is the primary direction in which the first flow of gas propagates and about which the first flow of gas diverges. As noted above, the first flow of gas has a spaced relationship from the vibrating tray which, in other words, indicates that the first direction in which the first gas nozzle directs the first flow of gas does not intersect the vibrating tray. Indeed, in one embodiment, the first direction is parallel with a surface of the vibrating tray.

As shown in FIGS. 1 and 2, the dust extraction system also includes a second gas nozzle 22 configured to direct a second flow of gas toward the vibrating tray 14. The second flow may also include various types of gases. In one embodiment, however, the first and second gas nozzles are each configured to direct first and second flows, respectively, of the same gas, such as air, relative to the vibrating tray. As noted, the second gas nozzle is configured to direct the second flow toward the vibrating tray. Thus, the second gas nozzle is configured to direct the second flow of gas in a second direction 22*a* that extends toward and may intersect the vibrating tray. As noted with respect to the first flow of gas, the second flow of gas may also diverge as the second flow of gas exits the second gas nozzle. However, the second direction in which the second gas nozzle directs the second flow of gas is the primary direction in which the second flow of gas propagates and about which there may be some divergence. The second flow of gas is angularly offset from the first direction 20*a* in which the first flow of gas propagates by an acute angle 23. In one embodiment, the acute angle between the first and second directions in which the first and second flows of gas, respectively, propagate is between about 30 degrees and 60 degrees and, more particularly, about 45 degrees. However, the angular offset between the first and second directions may vary depending upon the relative position of the first and second gas nozzles to the vibrating tray.

The first flow of gas is generally greater in terms of the quantity of the gas than the second flow of gas. For example, the first flow of gas may be at least three times greater than the second flow of gas and, in one embodiment, the first flow of gas may include between 75% and 95% of the entire flow of gas, while the second flow of gas includes between 25% and 5%, respectively, of the entire flow. By including more gas in the first flow of gas than in the second flow of gas, the first flow of gas may create a region of lower pressure so as to draw dust into the first flow of gas, while still providing a sufficient, albeit smaller flow of gas to lift and remove the gas from the vibrating tray 14 and the tablets 12 carried thereby.

The first and second gas nozzles 20, 22 may be connected to a supply of gas, such as a supply of compressed gas, such as a supply of compressed air. The first and second gas nozzles are generally positioned alongside the vibrating tray 14 such that the first and second directions 20*a*, 22*a* along which the first and second flows of gas propagate extend across the vibrating tray, such as across a plurality of channels 16 and, in one embodiment, substantially perpendicular to the longitudinal axes defined by the plurality of channels between the opposed first and second ends 16*a*, 16*b*. The first and second gas nozzles may be positioned relative to the vibrating tray such that the second flow of gas that is directed toward the vibrating tray comes into contact with the vibrating tray at or near the channel that is closest to the edge along which the first and second gas nozzles are positioned. As such, the dust extraction system of this embodiment may remove dust from the entire surface of the vibrating tray including each of the channels.

The impingement of the second flow of gas with the vibrating tray 14 and the tablets carried by the vibrating tray may remove dust from the tablets and the vibrating tray, such as by lifting the dust from the vibrating tray, entraining the dust within the second flow of gas or the like. Although the first flow of gas is spaced apart from the vibrating tray, the first flow of gas across the vibrating tray creates a region of lower pressure that draws or suctions the dust, such that the dust lifted from the vibrating tray by the second flow of gas is drawn into the first flow of gas such that the dust is then directed across and away from the vibrating tray.

The dust extraction system may also include a receiving hood 24 positioned downstream of the vibrating tray 14 in the first and second gas nozzles 20, 22. The receiving hood is configured to collect at least a portion of the gas provided by the first and second gas nozzles as well as dust from the plurality of tablets 12. In this regard, the receiving hood is positioned downstream of the vibrating tray such that the dust that is removed from the vibrating tray and the tablets by the second flow of gas and is lifted away from the vibrating tray and directed thereacross by the first flow of gas will be collected by the receiving hood.

The receiving hood 24 may include a filter 26 in which the dust is trapped so as to prevent the dust from re-entering the environment surrounding the tablet packaging system 10. Additionally, the receiving hood may include an exhaust fan 28 positioned downstream of the filter for drawing gas into and through the receiving hood, thereby facilitating the entrapment of the dust within the filter. However, the receiving hood of one embodiment may not include a vacuum system and, as such, the cost and complexity of the receiving hood and the dust extraction system is reduced relative to a system that relies upon the introduction of a vacuum. As a result of the interaction of the first and second flows of gas with the dust upon the vibrating tray 14 and the tablets 12 carried thereby, however, a substantial percentage of the dust that is generated is directed to the receiving hood and collected such that the tablet packaging system and its surrounding environment remains cleaner for a longer period of time. Thus, the tablet packaging system need be taken offline for cleaning less frequently, thereby improving the efficiency of the packaging process. Additionally, sensors, such as the sensors employed by tablet counters, label verification systems and the like, may remain operational and properly functionable for longer periods of time.

As shown in FIG. 1, the dust extraction system of one embodiment may include a plurality of first gas nozzles 20 and a plurality of second gas nozzles 22. The plurality of first and second gas nozzles may be arranged in pairs which each pair including a respective first gas nozzle and a respective second gas nozzle. As shown in FIG. 1, the pairs of first and second gas nozzles may be spaced across a vibrating tray. In this regard, the pairs of first and second gas nozzles may be spaced across the vibrating tray so as to be spaced along the length of the channels 16. In an embodiment that includes three or more pairs of first and second gas nozzles, one pair of the first and second gas nozzles may be positioned proximate the first ends 16*a* of the channels, a second pair of first and second gas nozzles may be positioned proximate the second ends 16*b* of the channels, and the remainder of the pairs of the first and second gas nozzles may be positioned intermediate the first and second pairs of the first and second gas nozzles proximate respective medial portions of the channels.

While the first and second gas nozzles 20, 22 may be configured in various manners, the dust extraction system of one embodiment includes a manifold 30 that includes the plurality of pairs of first and second gas nozzles as shown in FIG. 1. The manifold may be operably connected to a supply of compressed gas, such as a supply of compressed air that is directed along the various arms of the manifold and then emitted via the plurality of pairs of first and second gas nozzles. In this embodiment, each arm of the manifold may include both a first gas nozzle and a second gas nozzle and a second gas nozzle with the second gas nozzle branching off from the first gas nozzle.

Figure 3:
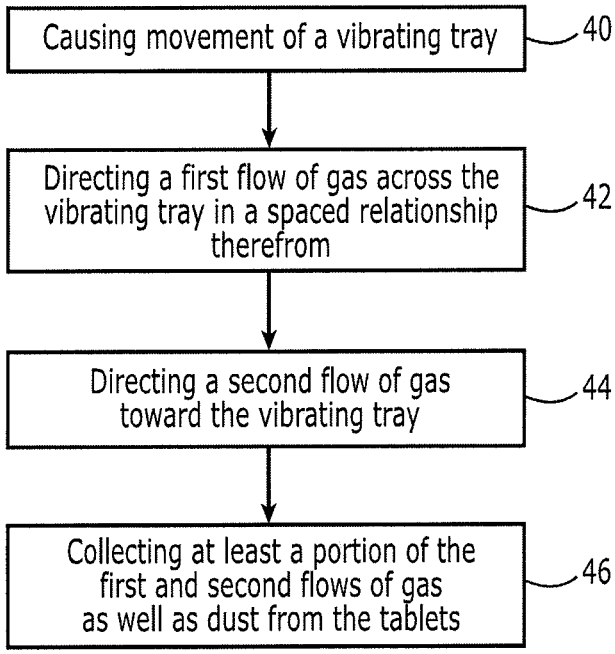
FIG. 3 is a flow chart illustrating operations performed in accordance with a method for packaging tablets according to one embodiment of the present invention.

As shown in FIG. 3 and as described above, the method for packaging tablets 12 may include causing movement of a vibrating tray 14 so as to feed a plurality of tablets to respective packages. See block 40. While the vibrating tray is being vibrated, a first flow of gas may be directed across the vibrating tray. See block 42. As described above, the first flow of gas may have a spaced relationship from the vibrating tray and may create a region of lower pressure to draw the dust into the first flow of gas. The method may also direct a second flow of gas toward the vibrating tray. See block 44. For example, the second flow of gas may be directed in a second direction that is angularly offset from the first direction in which the first flow of gas is directed by an acute angle. The method may also collect at least a portion of the first and second flows of gas and dust from the plurality of tablets, such as by trapping the dust in a filter. See block 46. As such, the environment surrounding the tablet packaging system 10 remains cleaner and the tablet packaging system need not be taken offline for cleaning as frequently, thereby improving the efficiency of the tablet packaging system and method of one embodiment of the present invention.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A tablet packaging system comprising:

a vibrating tray configured to feed a plurality of tablets to respective packages;

a first gas nozzle configured to direct a first flow of gas across the vibrating tray with the first flow of gas having a spaced relationship from the vibrating tray;

a second gas nozzle configured to direct a second flow of gas toward the vibrating tray; and a receiving hood configured to collect at least a portion of the gas provided by the first and second gas nozzles and dust from the plurality of tablets.

2. A tablet packaging system according to claim 1 further comprising a plurality of first gas nozzles and a plurality of second gas nozzles, wherein the plurality of first and second gas nozzles are spaced across the vibrating tray.

3. A tablet packaging system according to claim 2 wherein the plurality of first and second gas nozzles are arranged in pairs with each pair including a respective first gas nozzle and a respective second gas nozzle.

4. A tablet packaging system according to claim 1 wherein the first gas nozzle is configured to direct the first flow of gas in a first direction and the second gas nozzle is configured to direct the second flow of gas in a second direction that is angularly offset from the first direction by an acute angle.

5. A tablet packaging system according to claim 1 wherein the first and second gas nozzles are configured such that the first flow of gas is greater than the second flow of gas.

6. A tablet packaging system according to claim 5 wherein the first and second gas nozzles are configured such that the first flow of gas is at least three times greater than the second flow of gas.

7. A tablet packaging system according to claim 1 wherein the receiving hood comprises a filter and an exhaust fan downstream of the filter.

8. A dust extraction system comprising:

a first gas nozzle configured to direct a first flow of gas in a first direction across a vibrating tray configured to carry a plurality of tablets, wherein the first gas nozzle is configured to direct the first flow of gas to have a spaced relationship from the vibrating tray;

a second gas nozzle configured to direct a second flow of gas in a second direction toward the vibrating tray, wherein the second direction is angularly offset from the first direction by an acute angle; and a receiving hood configured to collect at least a portion of the gas provided by the first and second gas nozzles and dust from the plurality of tablets.

9. A dust extraction system according to claim 8 further comprising a plurality of first gas nozzles and a plurality of second gas nozzles, wherein the plurality of first and second gas nozzles are spaced across the vibrating tray.

10. A dust extraction system according to claim 9 wherein the plurality of first and second gas nozzles are arranged in pairs with each pair including a respective first gas nozzle and a respective second gas nozzle.

11. A dust extraction system according to claim 8 wherein the first and second gas nozzles are configured such that the first flow of gas is greater than the second flow of gas.

12. A dust extraction system according to claim 11 wherein the first and second gas nozzles are configured such that the first flow of gas is at least three times greater than the second flow of gas.

13. A dust extraction system according to claim 8 wherein the receiving hood comprises a filter and an exhaust fan downstream of the filter.

14. A method for packaging tablets comprising:

causing movement of a vibrating tray so as to feed a plurality of tablets to respective packages;

directing a first flow of gas across the vibrating tray with the first flow of gas having a spaced relationship from the vibrating tray;

directing a second flow of gas toward the vibrating tray; and collecting at least a portion of the first and second flows of gas and dust from the plurality of tablets.

15. A method according to claim 14 wherein directing the first flow of gas across the vibrating tray comprises creating a region of lower pressure to draw the dust into the first flow of gas.

16. A method according to claim 14 wherein directing the first flow of gas across the vibrating tray comprises directing a plurality of first flows of gas across the vibrating tray, wherein directing the second flow of gas toward the vibrating tray comprises directing a plurality of second flows of gas toward the vibrating tray, and wherein the first and second flows of gas are spaced across the vibrating tray.

17. A method according to claim 14 wherein directing the first flow of gas comprises directing the first flow of gas in a first direction, and wherein directing the second flow of gas comprises directing the second flow of gas in a second direction that is angularly offset from the first direction by an acute angle.

18. A method according to claim 14 wherein the first flow of gas is greater than the second flow of gas.

19. A method according to claim 18 wherein the first flow of gas is at least three times greater than the second flow of gas.

20. A method according to claim 14 wherein collecting at least a portion of the first and second flows of gas and dust from the plurality of tablets comprises trapping the dust in a filter.

* * * * *